US010013944B2

(12) United States Patent
Iwami

(10) Patent No.: US 10,013,944 B2
(45) Date of Patent: Jul. 3, 2018

(54) DISPLAY DEVICE AND SOURCE DRIVER FOR BIT CONVERSION OF IMAGE DATA

(71) Applicant: Panasonic Liquid Crystal Display Co., Ltd., Hyogo (JP)

(72) Inventor: Takashi Iwami, Hyogo (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 124 days.

(21) Appl. No.: 14/953,015

(22) Filed: Nov. 27, 2015

(65) Prior Publication Data

US 2017/0154597 A1 Jun. 1, 2017

(51) Int. Cl.
*G09G 3/36* (2006.01)

(52) U.S. Cl.
CPC ..... *G09G 3/3688* (2013.01); *G09G 2310/027* (2013.01); *G09G 2310/08* (2013.01); *G09G 2350/00* (2013.01)

(58) Field of Classification Search
None
See application file for complete search history.

(56) References Cited

U.S. PATENT DOCUMENTS

2002/0042683 A1* 4/2002 Shincovich ..... H04B 3/54 702/61
2005/0201411 A1* 9/2005 Shibata ..... H04L 12/40032 370/463
2005/0204087 A1* 9/2005 Honda ..... G06F 3/1423 710/305
2007/0162807 A1* 7/2007 Kurayama ..... G01R 31/31813 714/738
2007/0252738 A1* 11/2007 Nakagawa ..... G11B 20/1426 341/143
2007/0269118 A1* 11/2007 Sasaki ..... H04N 19/70 382/232
2007/0279264 A1* 12/2007 Nakagawa ..... G11B 20/1426 341/55
2008/0298336 A1* 12/2008 Gollamudi ..... H04B 7/022 370/343
2012/0120043 A1* 5/2012 Cho ..... G09G 3/2092 345/211
2012/0242628 A1* 9/2012 Yuan ..... G09G 3/20 345/204
2012/0243636 A1 9/2012 Yamagishi et al.
2014/0281097 A1 9/2014 Yamagishi et al.
2015/0317270 A1 11/2015 Yamagishi et al.
2016/0127771 A1* 5/2016 Pasqualino ..... H04N 21/43635 348/474

FOREIGN PATENT DOCUMENTS

JP 2011-123609 A 6/2011

* cited by examiner

*Primary Examiner* — Michael J Cobb
(74) *Attorney, Agent, or Firm* — HEA Law PLLC

(57) ABSTRACT

Provided is a display device, including: a display panel configured to display an image; a timing controller including a first data conversion unit configured to encode image data that is input from outside; and a source driver including a second data conversion unit configured to decode image data that is output from the timing controller. The second data conversion unit is configured to decode the image data that is output from the timing controller by switching, based on time, between a plurality of conversion patterns different from one another in bit pattern.

6 Claims, 8 Drawing Sheets

FIG.3

| GRADATION | 8b | 9b |
|---|---|---|
| 0 | 00000000 | 000000001 |
| 1 | 00000001 | 000000010 |
| 2 | 00000010 | 000000101 |
| 3 | 00000011 | 000000110 |
| ... | ... | ... |
| 253 | 11111101 | 111111010 |
| 254 | 11111110 | 111111101 |
| 255 | 11111111 | 111111110 |

FIG.4

| GRADATION | 8b | 9b |
|---|---|---|
| 0 | 00000000 | 011010011 |
| 1 | 00000001 | 101100011 |
| 2 | 00000010 | 101100100 |
| 3 | 00000011 | 011010100 |
| ... | ... | ... |
| 253 | 11111101 | 010011011 |
| 254 | 11111110 | 010011100 |
| 255 | 11111111 | 100101100 |

DISPLAY DEVICE AND SOURCE DRIVER FOR BIT CONVERSION OF IMAGE DATA

BACKGROUND OF THE INVENTION

1. Field of the Invention

This application relates to a display device, a timing controller, and a source driver.

2. Description of the Related Art

Display devices that employ serial data transmission are being proposed in response to the increase in the volume of image data transmission in recent years. Serial data transmission uses a method of transmitting, for example, 10-bit data that has been converted from 8-bit data (hereinafter referred to as 8b/10b conversion) in order to stabilize data transmission.

In serial data transmission in general, transmitting the same data in succession generates harmonic noise having a frequency component that corresponds to the cycle of the pattern of the succession. A technology of reducing this harmonic noise is disclosed in, for example, Japanese Patent Application Laid-open No. 2011-123609. With the technology disclosed in the publication, a symbol is generated based on a pseudo-random number that is generated by a pseudo-random number generating circuit, and the symbol is converted by 8b/10b conversion for transmission.

SUMMARY OF THE INVENTION

However, the technology disclosed in the publication has a problem in that the need to generate a pseudo-random number makes the circuit configuration complex.

This application has been made in view of the problem described above, and an object of the this application is to provide a display device, a timing controller, and a source driver that are capable of reducing noise in data transmission with a simple configuration. In order to solve the above-mentioned problem, according to one embodiment of this application, there is provided a display device, including: a display panel configured to display an image; a timing controller including a first data conversion unit configured to encode image data that is input from outside; and a source driver including a second data conversion unit configured to decode image data that is output from the timing controller, the second data conversion unit being configured to decode the image data that is output from the timing controller by switching, based on time, between a plurality of conversion patterns different from one another in bit pattern.

In the display device according to one embodiment of this application, the second data conversion unit may be configured to decode the image data that is output from the timing controller by switching between the plurality of conversion patterns at random time intervals.

In the display device according to one embodiment of this application, the second data conversion unit may be configured to decode the image data that is output from the timing controller by switching from one of the plurality of conversion patterns to another for one of each vertical scanning period and each set of a plurality of vertical scanning periods.

In the display device according to one embodiment of this application, the second data conversion unit may be configured to decode the image data that is output from the timing controller by switching from one of the plurality of conversion patterns to another for one of each horizontal scanning period and each set of a plurality of horizontal scanning periods.

In the display device according to one embodiment of this application, the first data conversion unit may be configured to encode the image data that is input from the outside by switching from one of the plurality of conversion patterns to another based on time, and the timing controller may be configured to transmit, to the source driver, conversion pattern information indicating which one of the plurality of conversion patterns has been used by the first data conversion unit.

In the display device according to one embodiment of this application, the second data conversion unit may be configured to switch from one of the plurality of conversion patterns to another based on the conversion pattern information.

In the display device according to one embodiment of this application, the first data conversion unit may include at least one of an 8b/9b encoder configured to convert 8-bit data into 9-bit data, and an 8b/10b encoder configured to convert 8-bit data into 10-bit data, and the second data conversion unit may include at least one of an 8b/9b decoder configured to convert 9-bit data into 8-bit data, and an 8b/10b decoder configured to convert 10-bit data into 8-bit data.

In the display device according to one embodiment of this application, the first data conversion unit and the second data conversion unit may be each configured to refer to a table that associates a bit pattern of a first bit count with a bit pattern of a second bit count, to thereby execute bit conversion of image data.

In order to solve the above-mentioned problem, according to one embodiment of this application, there is provided a timing controller, including: a first reception unit configured to receive image data that is input from outside; a first data conversion unit configured to encode the image data that is received by the first reception unit; and a first output unit configured to output, to a source driver, the image data that is encoded by the first data conversion unit, the first data conversion unit being configured to encode the image data that is received by the first reception unit by switching, based on time, between a plurality of conversion patterns different from one another in bit pattern.

In order to solve the above-mentioned problem, according to one embodiment of this application, there is provided a source driver, including: a second reception unit configured to receive encoded image data that has been output from a timing controller; a second data conversion unit configured to decode the image data that is received by the second reception unit; and a second output unit configured to output, to a display panel, the image data that is decoded by the second data conversion unit, the second data conversion unit being configured to decode the image data that is received by the second reception unit by switching, based on time, between a plurality of conversion patterns different from one another in bit pattern.

BRIEF DESCRIPTION OF THE DRAWINGS

FIG. 3 is a diagram of a first conversion table according to the embodiment of this application.

FIG. 4 is a diagram of a second conversion table according to the embodiment of this application.

DETAILED DESCRIPTION OF THE INVENTION

An embodiment of this application is described below with reference to the accompanying drawings. The following description takes a liquid crystal display device as an example. However, a display device according to this application is not limited to liquid crystal display devices and can be, for example, an organic EL display device.

Figure 1:
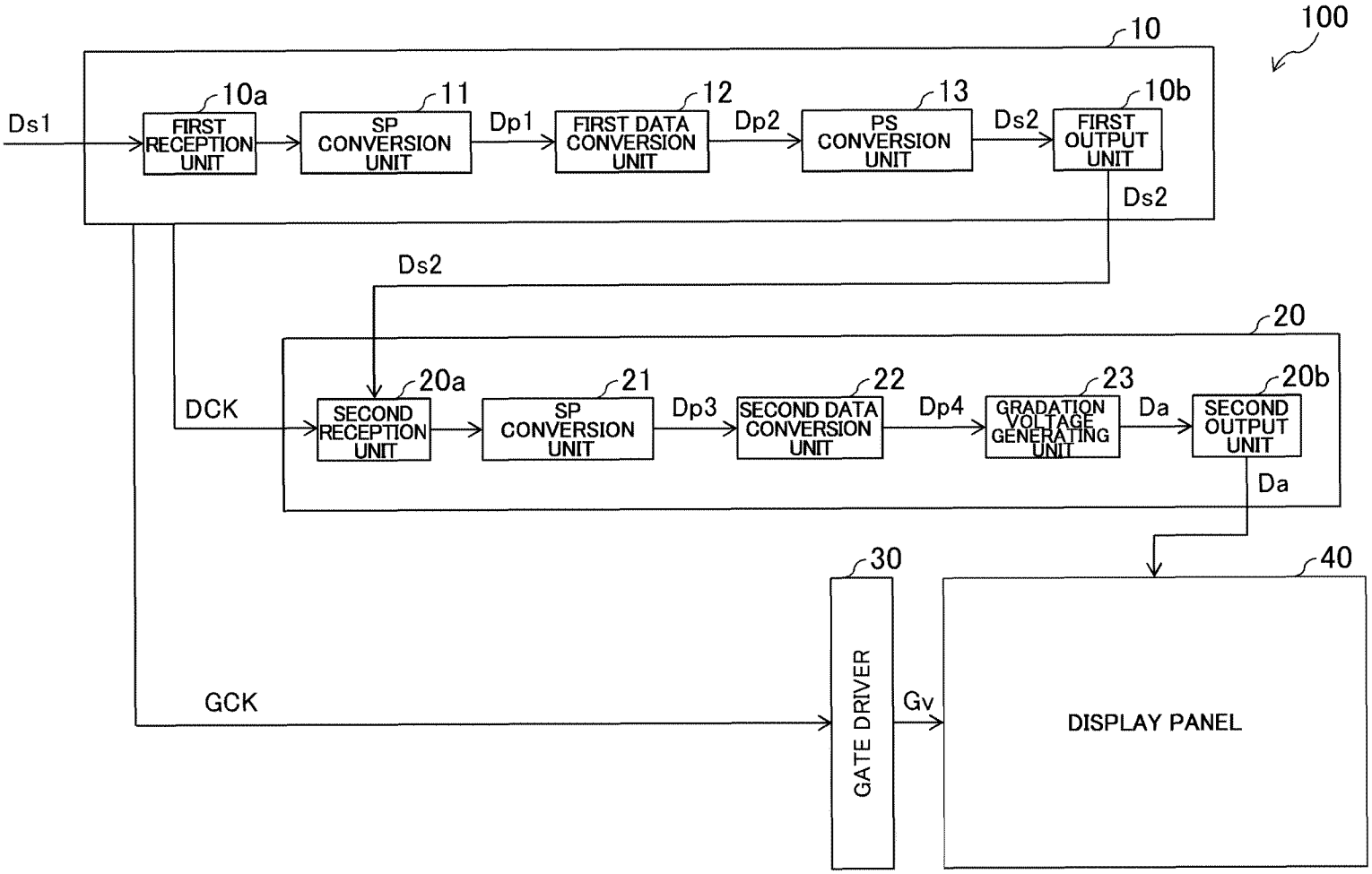
FIG. 1 is a diagram for illustrating the schematic configuration of a liquid crystal display device according to an embodiment of this application.

FIG. 1 is a diagram for illustrating the schematic configuration of a liquid crystal display device according to the embodiment of this application. The liquid crystal display device according to this embodiment transmits data by serial data transmission. A liquid crystal display device 100 includes a timing controller 10, a source driver 20, a gate driver 30, and a display panel 40.

The timing controller 10 includes a first reception unit 10*a*, a serial/parallel conversion unit 11 (SP conversion unit), a first data conversion unit 12, a parallel/serial conversion unit 13 (PS conversion unit) , and a first output unit 10*b*. A system (not shown) provided outside the liquid crystal display device 100 outputs, for example, image data Ds1, which is serial data, and a timing signal (e.g., clock signal) to the timing controller 10. The first reception unit 10*a* of the timing controller 10 receives the image data Ds1 and the timing signal.

The serial/parallel conversion unit 11 converts the image data Ds1, which is serial data received by the first reception unit 10*a*, into image data Dp1, which is parallel data. The image data Dp1 is input to the first data conversion unit 12.

The first data conversion unit 12 encodes the image data Dp1 by bit conversion. For example, the first data conversion unit 12 encodes the image data Dp1 that is 8-bit data into image data Dp2 that is 9-bit data. The first data conversion unit 12 in this case functions as an 8b/9b encoder. To give another example, the first data conversion unit 12 encodes the image data Dpi that is 8-bit data into the image data Dp2 that is 10-bit data. The first data conversion unit 12 in this case functions as an 8b/10b encoder.

The data bit conversion in the first data conversion unit 12 is not limited to 8b/9b conversion and 8b/10b conversion, and a known bit conversion method can be employed. The specific configuration of the first data conversion unit 12 is described later. The image data Dp2 is input to the parallel/serial conversion unit 13.

The parallel/serial conversion unit 13 converts the image data Dp2, which is parallel data, into image data Ds2, which is serial data. The first output unit 10*b* outputs the image data Ds2 to the source driver 20.

The timing controller 10 executes known processing in addition to the processing described above. For example, the timing controller 10 generates control signals for controlling the operation of the source driver 20 and the gate driver 30 (a data clock DCK, a gate clock GCK, and the like) based on the timing signal described above. For example, the timing controller 10 outputs the data clock DCK to the source driver 20 and outputs the gate clock GCK to the gate driver 30. The timing controller 10 in this embodiment outputs the data clock DCK and other control signals separately from the image data Ds2. Alternatively, the control signals may be embedded in the image data Ds2 to be output.

The source driver 20 receives the image data Ds2 and a relevant control signal that are output from the timing controller 10, and generates a gradation voltage based on the image data Ds2 and the control signal. The source driver 20 outputs the generated gradation voltage to the display panel 40. The source driver 20 includes a second reception unit 20*a*, a serial/parallel conversion unit 21 (SP conversion unit) , a second data conversion unit 22, a gradation voltage generating unit 23, and a second output unit 20*b*.

The second reception unit 20*a* of the source driver 20 receives the image data Ds2 and a relevant control signal. The serial/parallel conversion unit 21 converts the image data Ds2, which is serial data received by the second reception unit 20*a*, into image data Dp3, which is parallel data. The image data Dp3 is input to the second data conversion unit 22.

The second data conversion unit 22 decodes the image data Dp3 by bit conversion. For example, the second data conversion unit 22 decodes the image data Dp3 that is 9-bit data into image data Dp4 that is 8-bit data. The second data conversion unit 22 in this case functions as an 8b/9b decoder. To give another example, the second data conversion unit 22 decodes the image data Dp3 that is 10-bit data into image data Dp4 that is 8-bit data. The second data conversion unit 22 in this case functions as an 8b/10b decoder. The data bit conversion in the second data conversion unit 22 is not limited to 8b/9b conversion and 8b/10b conversion, and a known bit conversion method can be employed. The specific configuration of the second data conversion unit 22 is described later. The image data Dp4 is input to the gradation voltage generating unit 23.

The gradation voltage generating unit 23 generates a gradation voltage Da based on the image data Dp4. The gradation voltage can be generated by a known method. The second output unit 20*b* outputs the gradation voltage Da to the display panel 40. The gradation voltage Da is supplied to a plurality of data lines of the display panel 40.

The gate driver 30 supplies a gate signal Gv to a plurality of gate lines of the display panel 40 one by one, based on a relevant control signal output from the timing controller 10. A known configuration can be employed as the configuration of the gate driver 30.

The specific configurations of the first data conversion unit 12 of the timing controller 10 and the second data conversion unit 22 of the source driver 20 are described next. The following description takes 8b/9b conversion as an example of the data bit conversion method used in the first data conversion unit 12 and the second data conversion unit 22.

Figure 2:
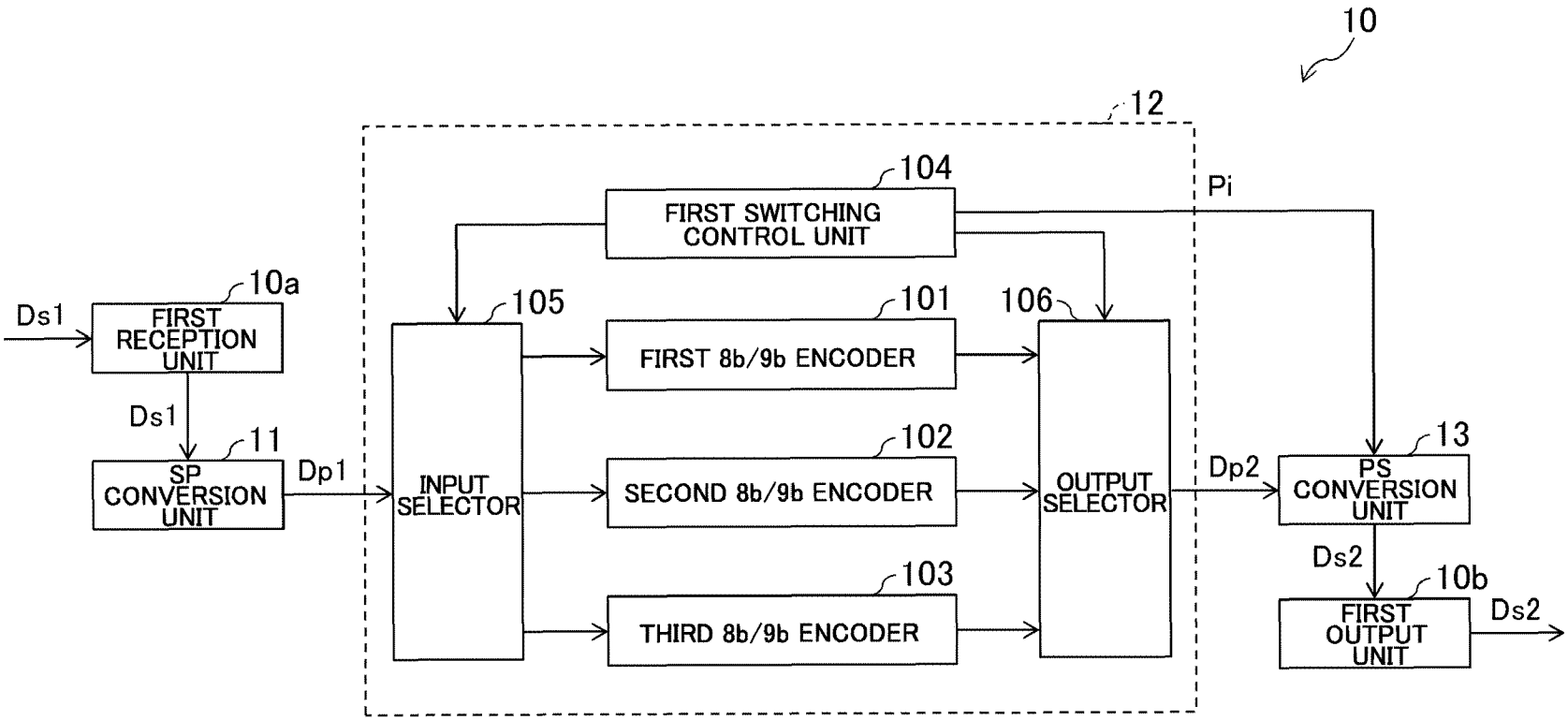
FIG. 2 is a block diagram for illustrating a specific configuration of a timing controller according to the embodiment of this application.

FIG. 2 is a block diagram for illustrating a specific configuration of the timing controller 10. As illustrated in FIG. 2, the first data conversion unit 12 includes a first 8b/9b encoder 101, a second 8b/9b encoder 102, a third 8b/9b encoder 103, a first switching control unit 104, an input selector 105, and an output selector 106.

The first 8b/9b encoder 101, the second 8b/9b encoder 102, and the third 8b/9b encoder 103 each encode the image data Dpi that is 8-bit data into the image data Dp2 that is 9-bit data. The first 8b/9b encoder 101, the second 8b/9b encoder 102, and the third 8b/9b encoder 103 execute the encoding so that the image data Dp2 converted throughbit conversion by the encoder 101, the image data Dp2 converted through bit conversion by the encoder 102, and the image data Dp2 converted through bit conversion by the encoder 103 differ from one another in bit pattern (an array of "0"s and "1"s) . For example, the first 8b/9b encoder 101 uses a first conversion table (first conversion pattern) to encode. The second 8b/9b encoder 102 uses a second conversion table (second conversion pattern) to encode. The third 8b/9b encoder 103 uses a third conversion table (third conversion pattern) to encode. Each conversion table associates a gradation level that corresponds to the image data Ds1, a bit pattern of 8 bits, and a bit pattern of 9 bits with one another.

The first conversion table, the second conversion table, and the third conversion table associate the same gradation level and the same 8-bit pattern with 9-bit patterns different from one another. The first conversion table is shown in FIG. 3 and the second conversion table is shown in FIG. 4 as an example. In the case where a gradation level corresponding to the image data Ds1 that is input is 253 gradations and the 8-bit pattern of the image data Dpi is "11111110", for example, the first 8b/9b encoder 101 uses the first conversion table to encode the image data Dpi into the image data Dp2 that has a 9-bit pattern "111111101", whereas the second 8b/9b encoder 102 uses the second conversion table to encode the image data Dpi into the image data Dp2 that has a 9-bit pattern "010011100".

The first switching control unit 104 makes a switch from one of the first 8b/9b encoder 101, the second 8b/9b encoder 102, and the third 8b/9b encoder 103 to another. Specifically, the first switching control unit 104 transmits a switching signal to the input selector 105 and the output selector 106 to switch from one of the first 8b/9b encoder 101, the second 8b/9b encoder 102, and the third 8b/9b encoder 103 to another.

The input selector 105 and the output selector 106 select an encoder based on the switching signal that is input from the first switching control unit 104. For example, the first 8b/9b encoder 101 is selected when a first switching signal is input from the first switching control unit 104 to the input selector 105 and the output selector 106, the second 8b/9b encoder 102 is selected when a second switching signal is input from the first switching control unit 104 to the input selector 105 and the output selector 106, and the third 8b/9b encoder 103 is selected when a third switching signal is input from the first switching control unit 104 to the input selector 105 and the output selector 106. In short, one of the first 8b/9b encoder 101, the second 8b/9b encoder 102, and the third 8b/9b encoder 103 is selected by means of the switching signal described above.

The first switching control unit 104 switches from one of the first 8b/9b encoder 101, the second 8b/9b encoder 102, and the third 8b/9b encoder 103 to another at, for example, random time intervals. When to switch encoders is not particularly limited. For example, the first switching control unit 104 may switch encoders for each vertical scanning period or each set of a plurality of vertical scanning periods, or for each horizontal scanning period or each set of a plurality of horizontal scanning periods. To give another example, the first switching control unit 104 may switch encoders at random points within a single vertical scanning period while switching encoders for each vertical scanning period.

The first switching control unit 104 transmits to the parallel/serial conversion unit 13 conversion pattern information Pi, which indicates a conversion pattern corresponding to one of the first 8b/9b encoder 101, the second 8b/9b encoder 102, and the third 8b/9b encoder 103 that is currently selected. The parallel/serial conversion unit 13 adds the conversion pattern information Pi to the image data Ds2 to output the image data Ds2 that includes the conversion pattern information Pi to the source driver 20 via the first output unit 10*b*. The first switching control unit 104 may instead output the conversion pattern information Pi to the source driver 20 via a signal line of a separate system.

The first data conversion unit 12 thus encodes the image data Ds1 input to the timing controller 10 while switching from one of the first 8b/9b encoder 101, the second 8b/9b encoder 102, and the third 8b/9b encoder 103 to another based on time, and thereby making a time-based switch between a plurality of conversion patterns different from one another in bit pattern.

Figure 5:
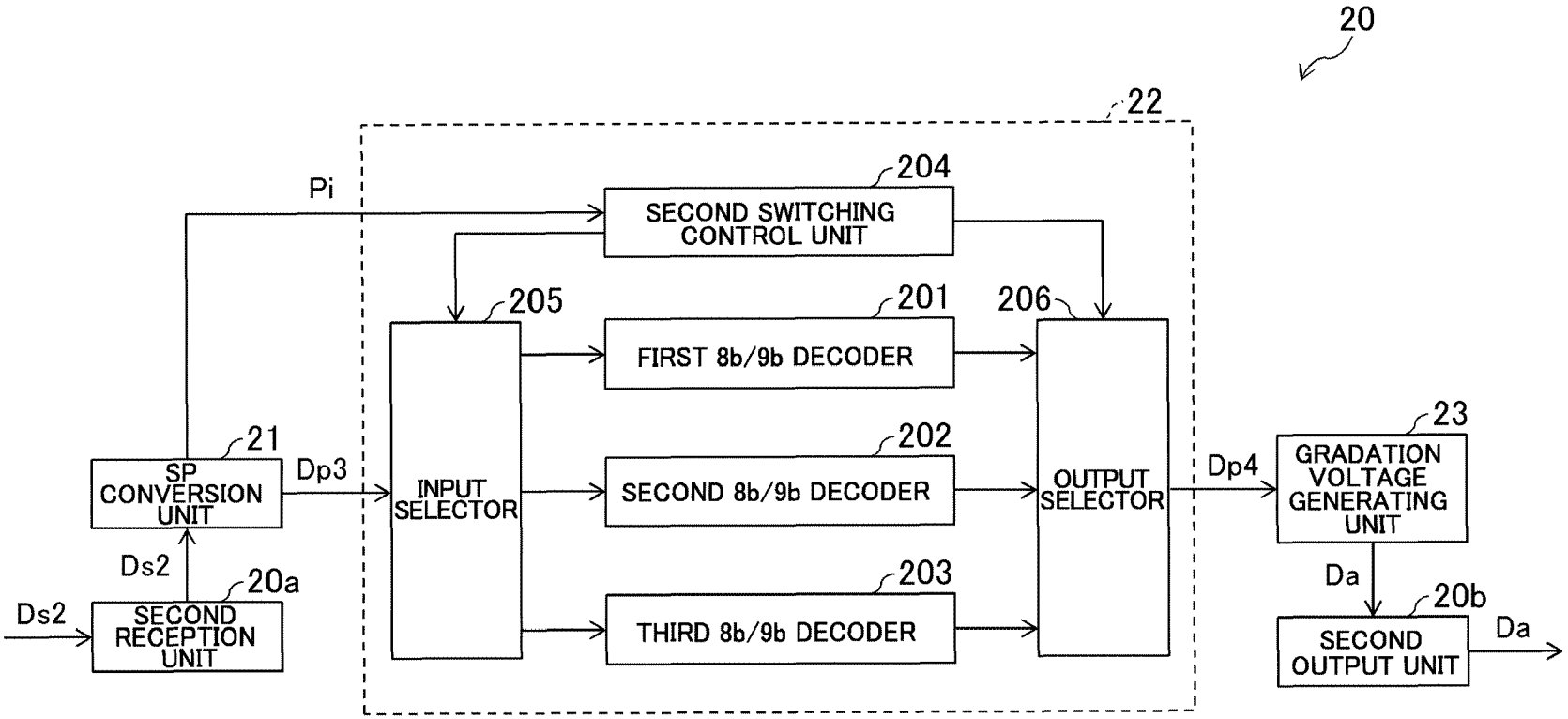
FIG. 5 is a block diagram for illustrating a specific configuration of a source driver according to the embodiment of this application.

FIG. 5 is a block diagram for illustrating a specific configuration of the source driver 20. As illustrated in FIG. 5, the second data conversion unit 22 includes a first 8b/9b decoder 201, a second 8b/9b decoder 202, a third 8b/9b decoder 203, a second switching control unit 204, an input selector 205, and an output selector 206. The serial/parallel conversion unit 21 receives the image data Ds2 that includes the conversion pattern information Pi from the timing controller 10 via the second reception unit 20*a*, transmits the conversion pattern information Pi to the second switching control unit 204, and transmits the image data Dp3, which is created by conversion into parallel data, to the second data conversion unit 22.

The first 8b/9b decoder 201, the second 8b/9b decoder 202, and the third 8b/9b decoder 203 each decode the image data Dp3 that is 9-bit data into the image data Dp4 that is 8-bit data. For example, the first 8b/9b decoder 201 decodes with the use of the first conversion table (first conversion pattern) (see FIG. 3), which is used by the first 8b/9b encoder 101. The second 8b/9b decoder 202 decodes with the use of the second conversion table (second conversion pattern) (see FIG. 4), which is used by the second 8b/9b encoder 102. The third 8b/9b decoder 203 decodes with the use of the third conversion table (third conversion pattern), which is used by the third 8b/9b encoder 103. In the case where the image data Ds2 that is input has a 9-bit pattern "111111101", for example, the first 8b/9b decoder 201 uses the first conversion table to convert the image data Dp3 into the image data Dp4 that has an 8-bit pattern "11111110". In the case where the image data Ds2 that is input has a 9-bit pattern "010011100", the second 8b/9b decoder 202 uses the second conversion table to convert the image data Dp3 into the image data Dp4 that has an 8-bit pattern "11111110".

The second switching control unit 204 receives the conversion pattern information Pi from the serial/parallel conversion unit 21, and makes a switch to one of the first 8b/9b decoder 201, the second 8b/9b decoder 202, and the third 8b/9b decoder 203 that corresponds to a conversion pattern indicated by the conversion pattern information Pi. Specifically, the second switching control unit 204 transmits a switching signal that corresponds to the conversion pattern information Pi to the input selector 205 and the output selector 206 to switch from one of the first 8b/9b decoder 201, the second 8b/9b decoder 202, and the third 8b/9b decoder 203 to another.

The input selector 205 and the output selector 206 select a decoder based on the switching signal that is input from the second switching control unit 204. For example, the first 8b/9b decoder 201 is selected when a first switching signal is input from the second switching control unit 204 to the input selector 205 and the output selector 206, the second 8b/9b decoder 202 is selected when a second switching signal is input from the second switching control unit 204 to the input selector 205 and the output selector 206, and the third 8b/9b decoder 203 is selected when a third switching signal is input from the second switching control unit 204 to the input selector 205 and the output selector 206. The switching signals that are output from the first switching control unit 104 of the timing controller 10 may be input to the input selector 205 and the output selector 206.

The second switching control unit 204 outputs a switching signal based on the conversion pattern information Pi received from the timing controller 10, which means that a switch between encoders leads to a switch between decoders. Accordingly, the second switching control unit 204 may switch decoders at, for example, random time intervals, or may switch decoders for each vertical scanning period or each set of a plurality of vertical scanning periods, or for each horizontal scanning period or each set of a plurality of horizontal scanning periods. To give another example, the second switching control unit 204 may switch decoders at random points within a single vertical scanning period while switching decoders for each vertical scanning period.

The image data Dp4 created by the decoding is input to the gradation voltage generating unit 23, where the gradation voltage Da is generated.

The second data conversion unit 22 thus decodes the image data Ds2 output from the timing controller 10 by switching from one of the first 8b/9b decoder 201, the second 8b/9b decoder 202, and the third 8b/9b decoder 203 to another based on time, and thereby making a time-based switch between a plurality of conversion patterns different from one another in bit pattern.

In the liquid crystal display device 100 according to this embodiment, data changes are not patterned particularly because the first data conversion unit 12 and the second data conversion unit 22 are included, with the result that harmonic noise is reduced. Even in the case where a fixed pattern (white) is displayed in succession, for example, the ability to convert data with the use of a conversion pattern selected from different conversion patterns reduces the chance of data changes being patterned. In addition, switching conversion patterns at random time intervals does not easily allow the execution of data conversion to become cyclic, and harmonic noise is accordingly reduced even more. Further, the circuit configuration is not complex in the liquid crystal display device 100 according to this embodiment.

The bit conversion of image data is not limited to one that uses a conversion table. For example, a method of calculating a post-conversion bit pattern with an arithmetic circuit may be used to convert the bit count of image data. The number of conversion types is not limited to two or three, and any number of types larger than 1 can be used. A conversion pattern used by the first data conversion unit 12 and a conversion pattern (conversion table) used by the second data conversion unit 22 may differ from each other. Specifically, the first data conversion unit 12 may use a conversion pattern for encoding (conversion table for encoding) to execute bit conversion while the second data conversion unit 22 may use a conversion pattern for decoding (conversion table for decoding) to execute bit conversion. A preferred conversion pattern (conversion table) is set so as not to cause AC coupling and so as to be capable of catching the edge of a clock signal embedded in image data that is serial data.

Figure 6:
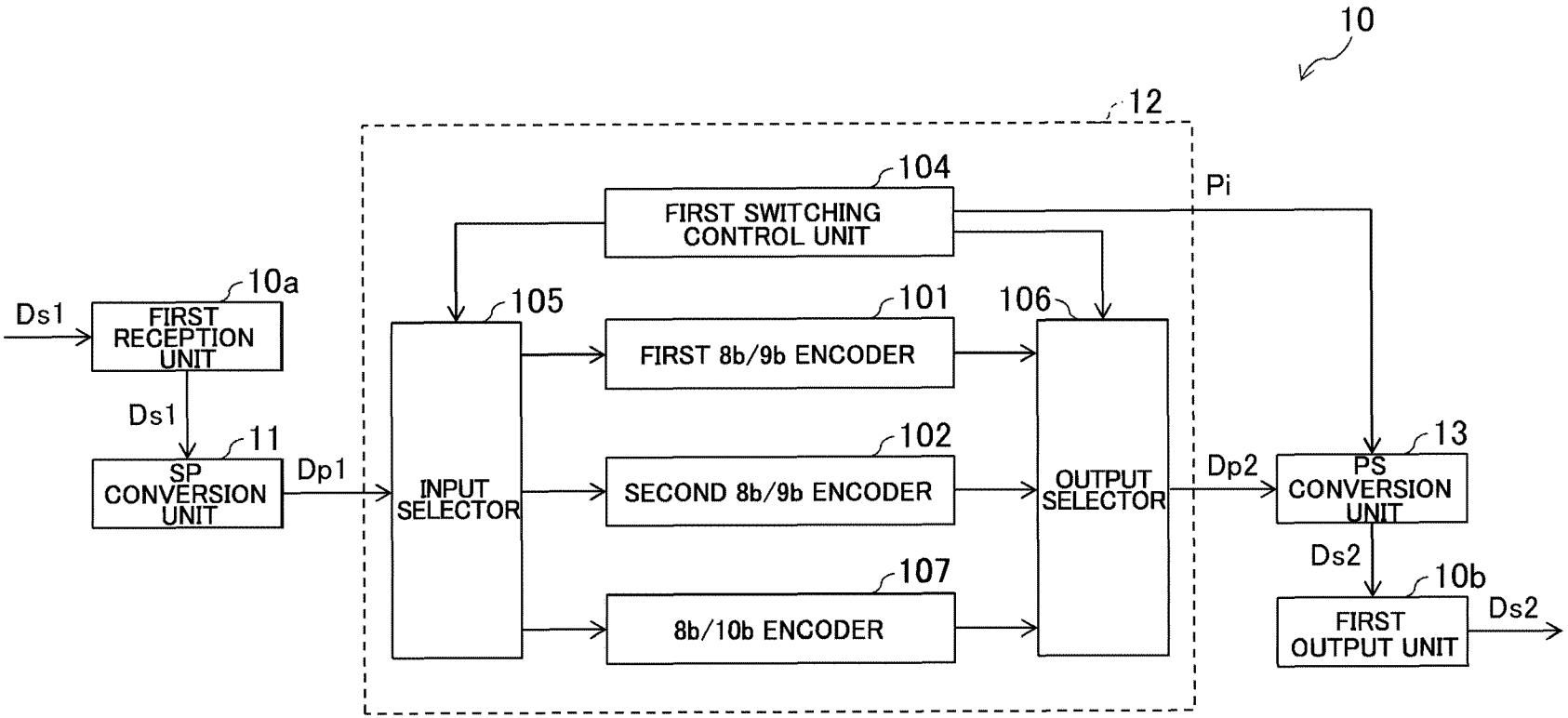
FIG. 6 is a block diagram for illustrating another configuration of the timing controller according to the embodiment of this application.
Figure 7:
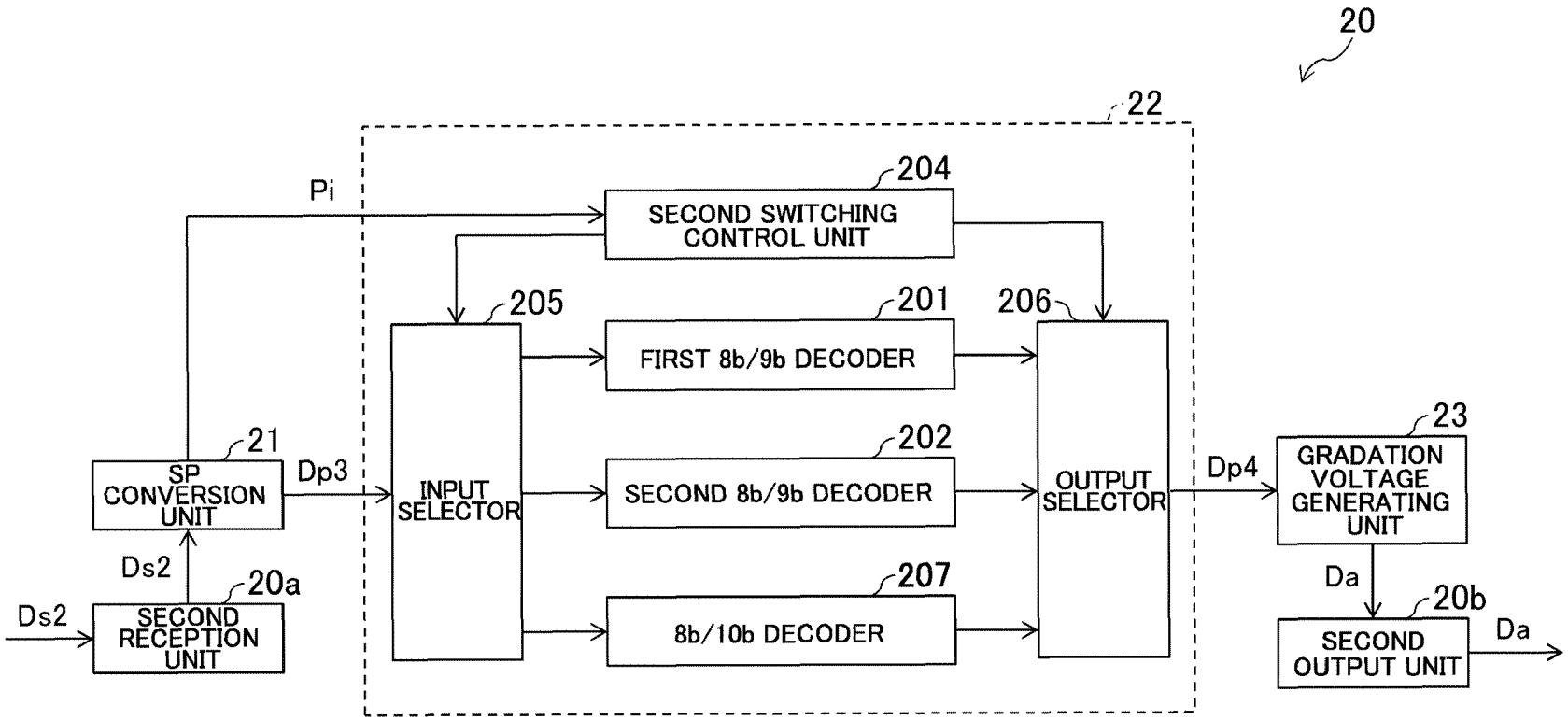
FIG. 7 is a block diagram for illustrating another configuration of the source driver according to the embodiment of this application.

The first data conversion unit 12 and the second data conversion unit 22 are not limited to the configurations described above. For example, as illustrated in FIG. 6, the first data conversion unit 12 may include an 8b/10b encoder 107 instead of the third 8b/9b encoder 103 of FIG. 2. Similarly, as illustrated in FIG. 7, the second data conversion unit 22 may include an 8b/10b decoder 207 instead of the third 8b/9b decoder 203 of FIG. 5. Then the first data conversion unit 12 may switch from one of the first 8b/9b encoder 101, the second 8b/9b encoder 102, and the 8b/10b encoder 107 to another based on time. Similarly, the second data conversion unit 22 may switch from one of the first 8b/9b decoder 201, the second 8b/9b 202, and the 8b/10b decoder 207 to another based on time. The encoder type is not limited to 8b/9b encoders and 8b/10b encoders, and the decoder type is not limited to 8b/9b decoders and 8b/10b decoders. The first data conversion unit 12 may thus include a plurality of types of encoders different from one another in conversion method. Similarly, the second data conversion unit 22 may include a plurality of types of decoders different from one another in conversion method.

Figure 8:
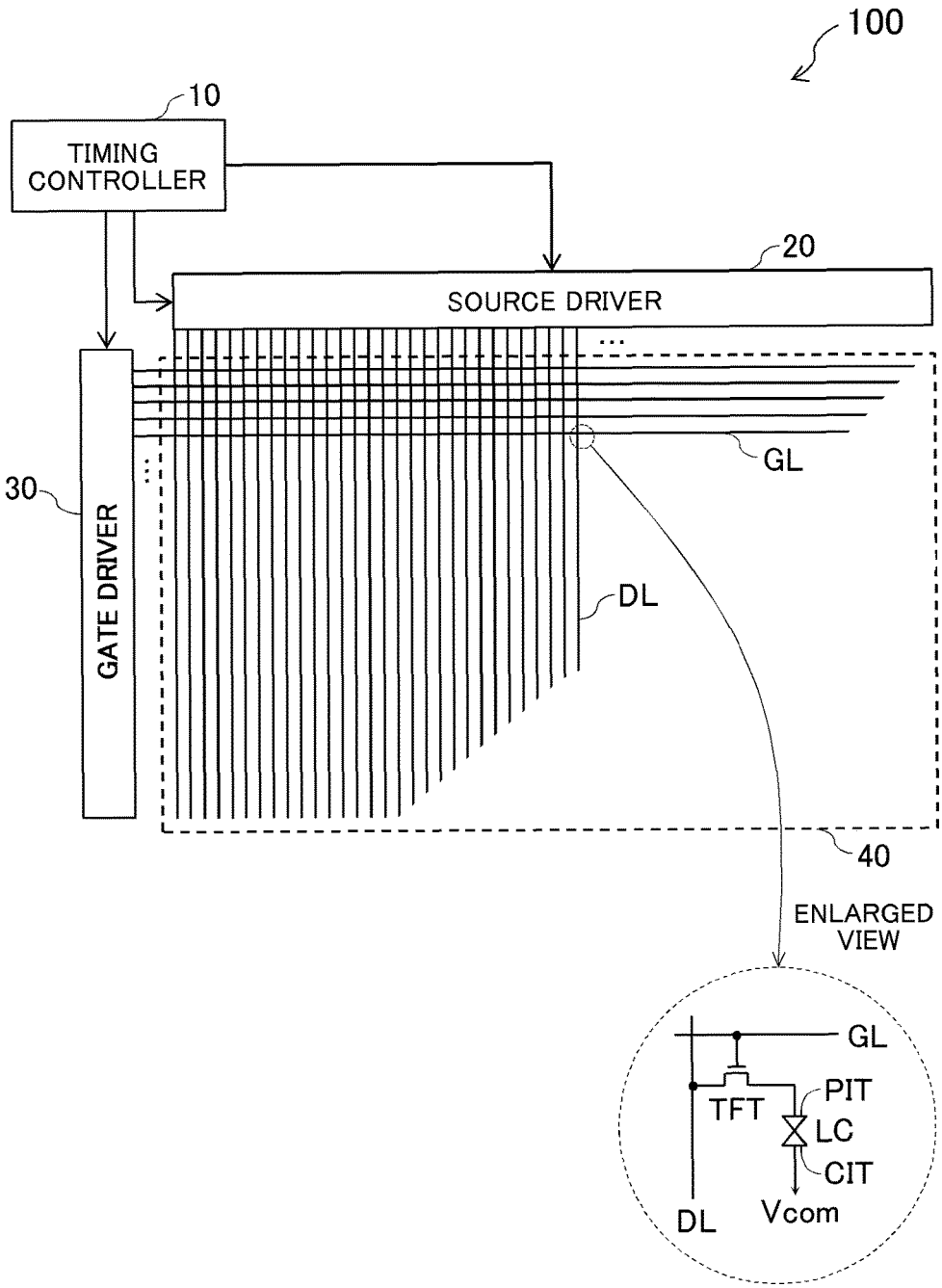
FIG. 8 is a diagram for illustrating the schematic configuration of a display panel according to the embodiment of this application.

A known configuration can be employed for the display panel 40. The configuration of the display panel 40 is described taking as an example a configuration that is illustrated in FIG. 8. FIG. 8 is a plan view for illustrating a specific configuration of the display panel 40.

The display panel 40 includes a thin film transistor (TFT) substrate (not shown), a color filter (CF) substrate (not shown), and a liquid crystal layer LC sandwiched between the substrates. The TFT substrate is provided with a plurality of data lines DL connected to the source driver 20 and a plurality of gate lines GL connected to the gate driver 30. A thin film transistor TFT is provided at each intersection between one data line DL and one gate line GL. The intersections correspond to a plurality of pixels arranged on the display panel 40 in a matrix pattern (in a row direction and a column direction). The display panel 40 further includes a pixel electrode PIT and a common electrode CIT for each pixel. The display panel 40 displays an image on a display screen by turning some thin film transistors TFT on with gate signals Gv, which are supplied to the gate lines GL, based on the gradation voltage Da, which is applied to the pixel electrodes PIT via the data lines DL. The source driver 20 and the gate driver 30 may be formed on the TFT substrate. The display panel 40 is not limited to the configuration described above, and can employ any known configuration.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device, comprising:

a display panel configured to display an image;

a timing controller comprising a first data conversion unit configured to encode image data that is input from outside of the display device by bit conversion;

a source driver comprising a second data conversion unit configured to decode image data that is output from the timing controller by bit conversion, a second data conversion unit being configured to decode the image data that is output from the timing controller by switching, based on time, between a plurality of conversion patterns different from one another in bit pattern, and wherein the second data conversion unit is configured to decode the image data that is output from the timing controller by switching between the plurality of conversion patterns according to conversion pattern information received from the first data conversion unit, which switched conversion patterns at random time intervals.

2. The display device according to claim 1, wherein the first data conversion unit is configured to encode the image data that is input from the outside by switching from one of the plurality of conversion patterns to another based on time, and wherein the timing controller is configured to transmit, to the source driver, conversion pattern information indicating which one of the plurality of conversion patterns has been used by the first data conversion unit.

3. The display device according to claim 2, wherein the second data conversion unit is configured to switch from one of the plurality of conversion patterns to another based on the conversion pattern information.

4. The display device according to claim 1, wherein the first data conversion unit comprises at least one of an 8b/9b encoder configured to convert 8-bit data into 9-bit data, and an 8b/10b encoder configured to convert 8-bit data into 10-bit data, and wherein the second data conversion unit comprises at least one of an 8b/9b decoder configured to convert 9-bit data into 8-bit data, and an 8b/10b decoder configured to convert 10-bit data into 8-bit data.

5. The display device according to claim 1, wherein the first data conversion unit and the second data conversion unit are each configured to refer to a table that associates a bit pattern of a first bit count with a bit pattern of a second hit count, to thereby execute bit conversion of image data.

6. A source driver, comprising:

a second reception unit configured to receive encoded image data that has been output from a timing controller by bit conversion;

a second data conversion unit configured to decode the image data that is received by the second reception unit by bit conversion; and a second output unit configured to output, to a display panel, the image data that is decoded by the second data conversion unit, the second data conversion unit being configured to decode the image data that is received by the second reception unit by switching, based on time, between a plurality of conversion patterns different from one another in bit pattern, wherein the second data conversion unit is configured to decode the image data that is output from the timing controller by switching between the plurality of conversion patterns according to conversion pattern information received from the second reception unit, which switched conversion patterns at random time intervals.

* * * * *